US006122461A

United States Patent [19]

Shinohara

[11] Patent Number: 6,122,461

[45] **Date of Patent: *Sep. 19, 2000**

[54] IMAGE PROCESSING APPARATUS AND CONTROL METHOD THEREFOR

[75] Inventor: Hayato Shinohara, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/104,275

[22] Filed: Jun. 25, 1998

[30] Foreign Application Priority Data

Jun. 26, 1997 [JP] Japan ..... 9-170649

[51] Int. Cl.[7] ..... G03G 15/00

[52] U.S. Cl. ..... 399/43; 399/82

[58] Field of Search ..... 399/38, 8, 43, 399/53, 82, 72, 49; 358/534, 406, 468

[56] References Cited

U.S. PATENT DOCUMENTS

| | | | |
|---|---|---|---|
| 4,888,636 | 12/1989 | Abe | 358/80 |
| 5,305,058 | 4/1994 | Sulenski et al. . | |
| 5,309,257 | 5/1994 | Bonino et al. | 358/504 |
| 5,394,251 | 2/1995 | Aikens | 358/500 |
| 5,566,372 | 10/1996 | Ikeda et al. . | |
| 5,572,330 | 11/1996 | Sasanuma | 358/298 |
| 5,579,090 | 11/1996 | Sasanuma et al. . | |
| 5,613,047 | 3/1997 | Shimomura et al. | 395/113 |
| 5,673,106 | 9/1997 | Thompson . | |
| 5,697,012 | 12/1997 | Sasanuma et al. | 399/49 |
| 5,752,126 | 5/1998 | Muramatsu | 399/44 |
| 5,859,933 | 1/1999 | Sasanuma et al. | 382/275 |

FOREIGN PATENT DOCUMENTS

| | | |
|---|---|---|
| 0 650 291 | 4/1995 | European Pat. Off. . |
| 0 654 757 | 5/1995 | European Pat. Off. . |
| 0 679 016 | 10/1995 | European Pat. Off. . |
| 8-9158 | 1/1996 | Japan . |
| 2 288 508 | 10/1995 | United Kingdom . |
| 96/16506 | 5/1996 | WIPO . |

*Primary Examiner*—Matthew S. Smith
*Attorney, Agent, or Firm*—Fitzpatrick, Cella, Harper & Scinto

[57] ABSTRACT

If density control is executed during continuous printing, not only the throughput of the interrupted job decreases, but also the density difference between images output before and after the printing interruption may become visually conspicuous. In this invention, a command and a status are exchanged with an external device, and the density of the visible image formed by an image forming section is controlled in accordance with a predetermined command received. When the number of visible images formed by the forming section reaches the first predetermined number, a status instructing execution of density control is transmitted to the external device. When no density control is executed upon transmission of the status instructing execution of the density control and the number of visible images formed by the forming section reaches the second predetermined number, density control is executed regardless of the predetermined command.

45 Claims, 11 Drawing Sheets

IMAGE PROCESSING APPARATUS AND CONTROL METHOD THEREFOR

BACKGROUND OF THE INVENTION

1. Field of the Invention

The present invention relates to an image processing apparatus and a control method therefor and, more particularly, to an image processing apparatus for forming a color image by electrophotography, and a control method therefor.

2. Description of the Related Art

Generally, when images are repeatedly formed in a color image forming apparatus, the density of output images gradually decreases. To prevent a drop in density of output images below the guaranteed quality level, the color image forming apparatus is set to forcibly interrupt printing and to execute density control of output images when the print number reaches a predetermined number.

FIG. 11 shows conventional density control. In FIG. 11, reference symbols J1, J2, and J3 denote print jobs. One job is made up of at least one continuous printing sequence. When the total print number by jobs reaches N2, density control a is executed to set the status representing "density control in progress" to level H. To obtain information for halftone density control, the image density must be measured. When a command instructing execution of density measurement is received during execution of density control, density measurement b is done upon completion of density control. The status indicating that density control is underway is reset upon completion of the density measurement.

The above-described density control technique in the conventional color image forming apparatus suffers the following problems. More specifically, when the print number reaches a predetermined number (N2), printing is forcibly interrupted even during continuous printing, like job J3 shown in FIG. 11, in order to execute density control. Several images (n images) scheduled to be continuously printed are left unprinted. Therefore, the throughput of the interrupted job (J3) greatly decreases owing to the n unprinted images.

Although the density of output images gradually decreases, the change is slow. In a given group of continuously printed output images, any change in density is not visually noticeable. However, when continuous printing is interrupted, and density control of output images is executed, the density difference between images output before and after the interruption may visually stand out.

SUMMARY OF THE INVENTION

It is an object of the present invention to provide an image processing apparatus which does not execute density control while images are continuously formed, and a control method therefor.

According to the present invention, the foregoing object is attained by providing an image processing apparatus comprising communication means for exchanging a command and a status with an external device, forming means for forming a visible image based on input image data on a recording medium; and density control means for controlling a density of the visible image formed by the forming means in accordance with a predetermined command received by the communication means, the density control means transmits a status instructing execution of the density control to said external device via the communication means when the number of visible images formed by said forming means reaches a first predetermined number, and executes the density control regardless of the predetermined command when no density control is executed upon transmission of the status instructing execution of the density control and the number of visible images formed by said forming means reaches a second predetermined number.

According to the present invention as described above, an image processing apparatus which does not execute density control while images are continuously formed can be provided.

It is another object of the present invention to provide an image processing apparatus in which wasteful density control is prevented by executing density control in accordance with the status of an image forming section, and a control method therefor.

According to the present invention, the foregoing object is attained by providing an image processing apparatus comprising density control means for causing an image forming section to form an image, and performing density control processing about image formation on the basis of data obtained by measuring the image; and discrimination means for discriminating a status of the image forming section, wherein the density control processing is inhibited in accordance with the discriminated status.

According to the present invention as described above, an image processing apparatus in which wasteful density control is prevented by executing density control in accordance with the status of an image forming section can be provided.

It is another object of the present invention to provide an image processing apparatus which automatically executes efficient density control in accordance with the characteristics of an image forming section, and a control method therefor.

According to the present invention, the foregoing object is attained by providing an image processing apparatus comprising control means for causing an image forming section to form an image, and controlling an execution timing of density control processing about image formation on the basis of data obtained by measuring the image, wherein the control means executing the density control processing at an activation timing of the image forming section, a timing when the number of images formed by the image forming section reaches a predetermined number N, and a timing when the number of images formed reaches a predetermined number M (N<M).

According to the present invention as described above, an image processing apparatus which automatically executes efficient density control in accordance with the characteristics of an image forming section can be provided.

The invention is particularly advantageous since an image processing apparatus, a control method therefor, and a storage medium, in which wasteful density control is prevented and efficient density control is automatically executed by performing density control in accordance with the status of an image forming section without carrying out density control during continuous image formation can be provided.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principle of the invention.

DESCRIPTION OF THE PREFERRED EMBODIMENTS

Preferred embodiments of the present invention will now be described in detail in accordance with the accompanying drawings.

First Embodiment

Figure 1:
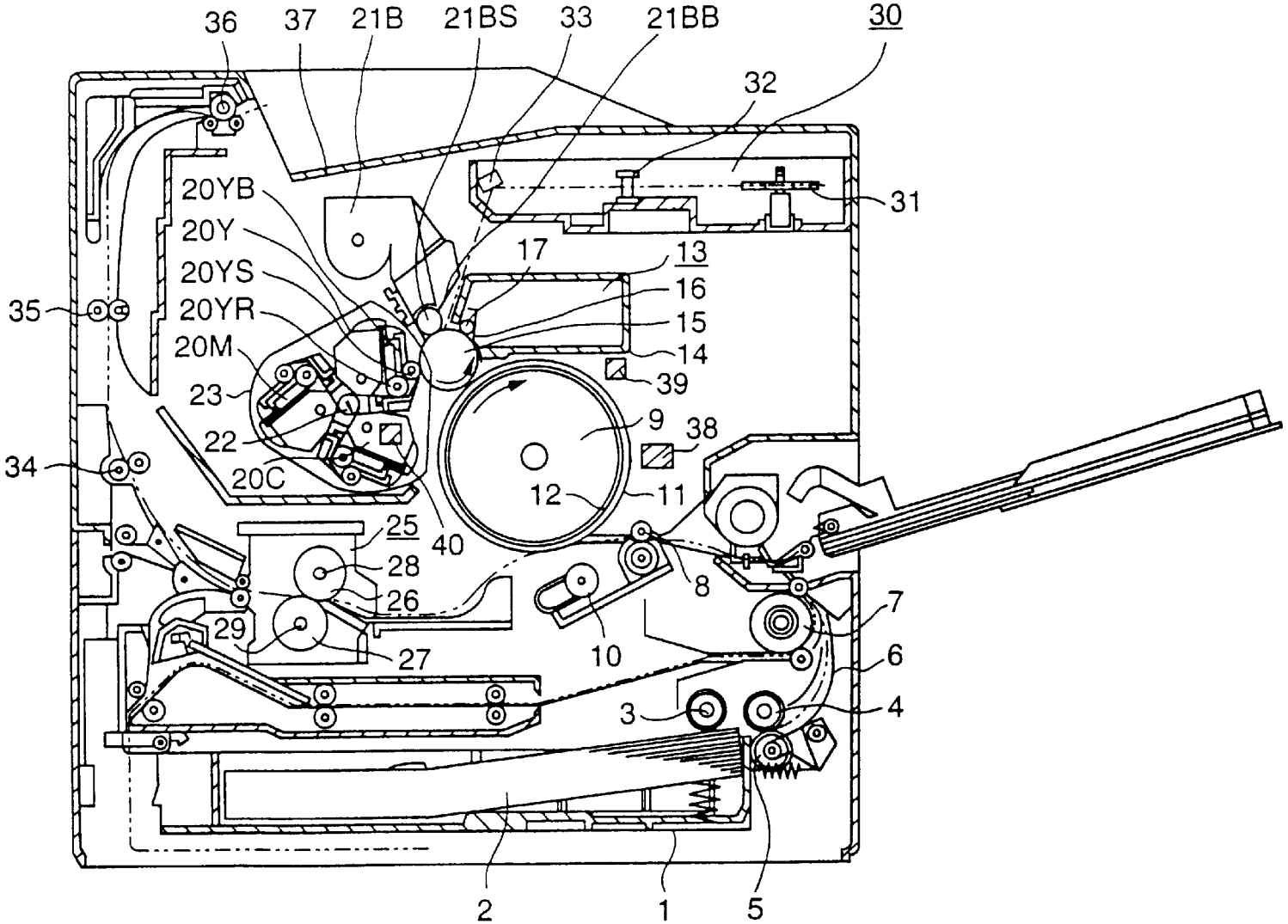
FIG. 1 is a schematic view for explaining an example of the arrangement of a color laser beam printer according to an embodiment of the present invention.

FIG. 1 is a schematic view for explaining an example of the arrangement of a color laser beam printer (to be referred to as a color LBP hereinafter) according to an embodiment of the present invention.

The color LBP shown in FIG. 1 comprises an image forming section including a photosensitive drum 15 which rotates in the direction of the arrow, a black developing unit 21B, and a developing rotary 23 made up of rotary developing units 20Y, 20M, and 20C for the respective colors. An electrostatic latent image for each color component formed on the photosensitive drum 15 by a laser beam output from a laser scanner 30 is developed with corresponding color toner by a corresponding one of the rotary developing units 20Y, 20M, and 20C in the developing rotary 23, and the black developing unit 21B. Multiple toner images are transferred onto the surface of an intermediate transfer drum 9. The toner images transferred onto the intermediate transfer drum 9 are transferred onto a recording sheet 2 supplied from a paper cassette 1, and fixed on the recording sheet 2 by a fixing unit 25. The full-color image formed on the recording sheet 2 in this manner is discharged to a discharge portion 37 on the upper surface of the apparatus.

Note that the developing rotary 23 and the black developing unit 21B can be separately detached from the printer main body.

As described above, the photosensitive drum 15 is exposed by a laser beam output from the laser scanner 30. More specifically, a laser beam output from a laser diode (not shown) in the laser scanner 30 driven in accordance with an image signal is reflected and deflected by a polygon mirror 31 to expose the surface of the photosensitive drum 15 rotating at a constant speed via an imaging lens 32 and a reflecting mirror 33.

The image forming section will be explained in detail.

[Drum Unit]

The photosensitive drum 15 and a vessel 14 of a cleaning unit serving as the holder of the photosensitive drum 15 integrally constitute a drum unit 13. The drum unit 13 is detachably supported by the printer main body and can be easily exchanged in accordance with the service life of the photosensitive drum 15.

The photosensitive drum 15 is prepared by applying an organic photoconductive layer on the outer circumferential surface of an aluminum cylinder having a predetermined diameter. The photosensitive drum 15 is rotatably supported by the vessel 14 of the cleaning unit. A cleaner blade 16 and a primary charger 17 are arranged around the photosensitive drum 15. The photosensitive drum 15 rotates counterclockwise in synchronism with image formation by the driving force of a driving motor (not shown) transmitted from one, rear end of the photosensitive drum 15 shown in FIG. 1.

The primary charger 17 using a contact charging method uniformly charges the surface of the photosensitive drum 15 by applying a voltage to a conductive roller in contact with the photosensitive drum 15.

The cleaning unit cleans toner left on the photosensitive drum 15 after a toner image on the photosensitive drum 15 is transferred onto the intermediate transfer drum 9. The cleaned residual toner is stored in the vessel 14. The amount of toner (to be referred to as a "waste toner" hereinafter) stored in the vessel 14 is set in consideration of the service life of the photosensitive drum 15, so the vessel 14 does not become full of waste toner before the photosensitive drum 15 reaches the service life. Therefore, the vessel 14 is exchanged at the same time as exchange of the photosensitive drum 15. To give the user a warning before the vessel 14 becomes full of waste toner, a sensor 39 for detecting the waste toner amount stored in the vessel 14 or the vacant state of the vessel 14 is provided. The sensor 39 optically detects the waste toner amount or the vacant state of the vessel 14, and a detailed description thereof will be omitted.

[Developing Unit]

The developing unit is constituted by the rotary developing units 20Y, 20M, and 20C and the black developing unit 21B for respectively developing yellow (Y), magenta (M), cyan (C), and black (B) images in order to visualize latent images on the photosensitive drum 15.

The black developing unit 21B is stationary. A sleeve 21BS is located at a position where it faces the photosensitive drum 15 with a small interval therefrom. The black developing unit 21B forms a visible image on the photosensitive drum 15 with black toner. The toner supplied from the vessel of the black developing unit 21B by a predetermined supply mechanism is applied on the outer circumferential surface of the sleeve 21BS rotating clockwise to form a thin layer by a coating blade 21BB in press contact with the outer circumferential surface of the sleeve 21BS. The toner layer is charged by friction. A predetermined developing bias is applied to the sleeve 21BS, and an amount of toner corresponding to the potential of the latent image formed on the photosensitive drum 15 is attracted by the photosensitive drum 15.

The rotary developing units 20Y, 20M, and 20C are detachably held by the developing rotary 23 rotating about a shaft 22. In forming an image, each developing unit rotates and moves around the shaft 22 while being held by the developing rotary 23. The developing rotary 23 stops rotating at a position where a predetermined developing unit faces the photosensitive drum 15. The developing sleeve of the developing unit is positioned to have a small interval with the photosensitive drum 15. The latent image formed on the photosensitive drum 15 is developed with toner.

In forming a color image, the developing rotary 23 rotates a given angle upon each revolution of the intermediate transfer drum 9 to sequentially develop by the yellow developing unit 20Y, the magenta developing unit 20M, the cyan developing unit 20C, and the black developing unit 21B. That is, while the intermediate transfer drum 9 rotates four times, yellow, magenta, cyan, and black toner images are sequentially formed. As a result, a full-color toner image is formed on the intermediate transfer drum 9.

FIG. 1 shows the state wherein the rotary developing unit 20Y stops at a position where it faces the photosensitive drum 15. Toner supplied from the vessel of the yellow developing unit 20Y by a predetermined supply mechanism is applied to the outer circumferential surface of a sleeve 20YS rotating clockwise to form a thin layer by a coating roller 2OYR rotating clockwise and a coating blade 2OYB in press contact with the outer circumferential surface of the sleeve 20YS. The toner layer is charged by friction. A predetermined developing bias is applied to the sleeve 20YS, and an amount of toner corresponding to the potential of the latent image formed on the photosensitive drum 15 is attracted by the photosensitive drum 15. The magenta developing unit 20M and the cyan developing unit 20C develop by the same mechanism.

When each of the color developing units 20Y, 20M, and 20C rotates and moves to the developing position, its sleeve is connected to a developing high-voltage power supply on the printer main body, and receives a driving force. That is, the sleeve is selectively applied with a voltage for each developing color and receives a driving force.

To give the user a warning before the residual toner amount in the developing unit adversely influences image formation, a sensor 40 for detecting the toner amount left in the developing unit is arranged. The sensor 40 optically detects the residual toner amount, and a detailed description thereof will be omitted.

[Intermediate Transfer Member]

In forming a color image, the intermediate transfer drum 9 rotates clockwise, as shown in FIG. 1, in order to receive four transfer operations by the photosensitive drum 15. The four color toner images on the intermediate transfer drum 9 are simultaneously transferred onto the recording sheet 2 by sandwiching and feeding the recording sheet 2 by the intermediate transfer drum 9 on which the multiple toner images are transferred, and a transfer roller 10 applied with a voltage.

The intermediate transfer drum 9 of the first embodiment is prepared by covering the outer circumferential surface of an aluminum cylinder 12 having a diameter of 180 mm with an elastic layer 11, such as a sponge layer or a rubber layer, having a predetermined resistivity. The intermediate transfer drum 9 is rotatably supported, and rotates via a gear (not shown) integrated with the intermediate transfer drum 9.

A sensor 38 for reading the density of a patch formed on the intermediate transfer drum 9 in image density control and image density measurement (to be described later) is placed near the intermediate transfer drum 9. The sensor 38 optically detects the patch density, and a detailed description thereof will be omitted.

[Paper Feed Section]

The paper feed section for feeding the recording sheet 2 to the image forming section is constituted by the cassette 1 storing a plurality of recording sheets 2, paper feed rollers 3 and 4, a leader roller 5 for preventing double feeding, a paper feed guide 6, a convey roller 7, a registration roller 8, and the like. In forming an image, the paper feed roller 3 rotates in accordance with image formation to separately feed the recording sheets 2 in the cassette 1 one by one. The fed recording sheet. 2 is guided by the paper feed guide 6 to reach the registration roller 8 via the convey roller 7.

The operation of the registration roller 8 during image formation includes non-rotating operation for keeping the recording sheet 2 still, and rotating operation for feeding the recording sheet 2 toward the intermediate transfer drum 9. These operations are performed by a predetermined sequence to align the position of the recording sheet 2 with the image position in the next transfer step.

[Transfer Section]

The transfer section is constructed by the swingable transfer roller 10. The transfer roller 10 is prepared by winding an expanded elastic member having a predetermined resistivity around a metal shaft, and is vertically movable in FIG. 1. While four color toner images are formed on the intermediate transfer drum 9, i.e., the intermediate transfer drum 9 rotates a plurality of number of times, the transfer roller 10 is retreated from the intermediate transfer drum 9 so as not to disturb the images.

After the four color toner images are formed on the intermediate transfer drum 9, the transfer roller 10 is pressed against the intermediate transfer drum 9 by a predetermined pressure by a cam member (not shown) so as to sandwich the recording sheet 2 in synchronism with the timing to transfer the toner images on the recording sheet 2. At this time, a predetermined bias voltage is applied to the transfer roller 10 to transfer the toner images on the intermediate transfer drum 9 to the recording sheet 2. As the intermediate transfer drum 9 and the transfer roller 10 are respectively driven to rotate, so that the recording sheet 2 sandwiched between them receives the toner images and is fed leftward in FIG. 1 to a fixing unit at a predetermined speed.

[Fixing Section]

The fixing section 25 fixes a toner image transferred to the recording sheet 2. As shown in FIG. 1, the fixing section 25 comprises a fixing roller 26 for applying heat to the recording sheet 2, and a press roller 27 for pressing the recording sheet 2 against the fixing roller 26. These rollers respectively have heaters 28 and 29 therein, and rotate to convey the recording sheet 2. That is, the recording sheet 2 on which the toner image is transferred is conveyed by the fixing roller 26 and the press roller 27. At the same time, the toner image is fixed by applying heat and pressure.

[Image Forming Operation]

Image forming operation by the above apparatus will be described in detail.

When image formation starts, the paper feed roller 3 rotates to separate one recording sheet 2 from the remaining sheets 2 in the cassette 1 and feed it to the registration roller 8.

In the image forming section, the photosensitive drum 15 and the intermediate transfer drum 9 rotate in the directions of the arrows shown in FIG. 1 to substantially uniformly charge the surface of the photosensitive drum 15. A laser beam corresponding to a yellow image is output from the laser scanner 30 to form a latent image corresponding to the yellow image on the photosensitive drum 15. At the same time as formation of the latent image, the yellow developing unit 20Y is driven. A voltage having the same polarity and almost the same potential as the charge polarity and potential of the photosensitive drum 15 is applied to the sleeve 20YS to develop the latent image with yellow toner.

A voltage having a polarity opposite to that for the yellow toner is applied to the intermediate transfer drum 9 to transfer the yellow toner image on the photosensitive drum 15 to the intermediate transfer drum 9. Upon completion of transfer of the yellow toner image to the intermediate transfer drum 9, the developing rotary 23 rotates to move the magenta developing unit 20M to a position where the unit 20M faces the photosensitive drum 15. By the same procedure as that for the yellow toner image, magenta, cyan, and black latent images are formed, developed, and transferred to the intermediate transfer drum 9. In this way, four, yellow, magenta, cyan, and black, toner images are superposed on the surface of the intermediate transfer drum 9.

After the four color toner images are superposed on the surface of the intermediate transfer drum 9, the recording sheet 2 kept still by the registration roller 8 is conveyed and pressed against the intermediate transfer drum 9 by the transfer roller 10. A bias having a polarity opposite to that of the toner is applied to transfer the four color toner images on the intermediate transfer drum 9 to the recording sheet 2. The recording sheet 2 on which the toner images are transferred is separated from the intermediate transfer drum 9 and conveyed to the fixing section 25. After the toner images are fixed, the recording sheet 2 is guided to discharge roller pairs 34, 35, and 36 and discharged to a discharge tray 37 on the upper surface of the apparatus with its image bearing surface facing down. Then, the image forming operation is complete.

[Control Section]

Figure 2:
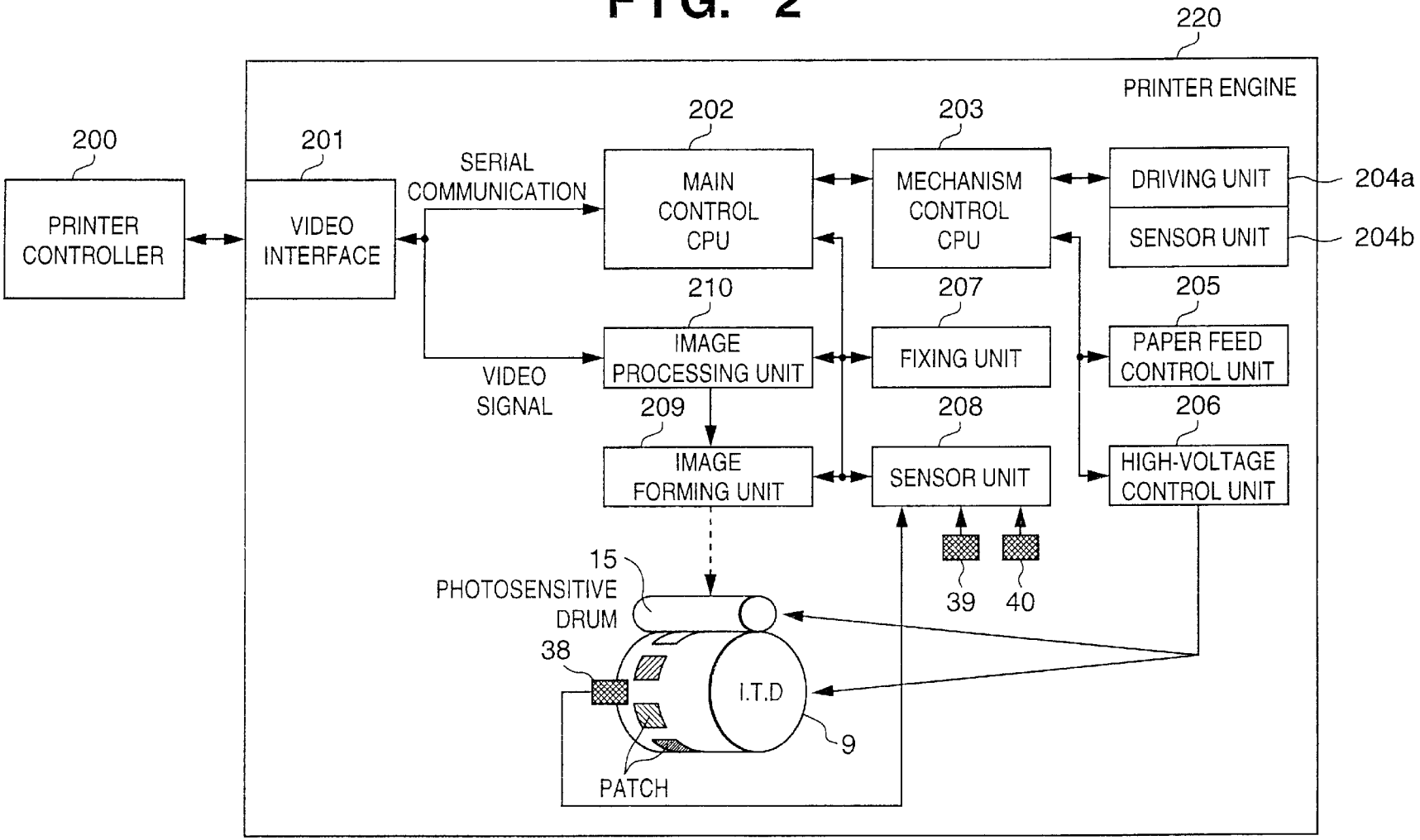
FIG. 2 is a block diagram showing an example of the control arrangement of the color laser beam printer according to the first embodiment.

FIG. 2 is a block diagram showing an example of the control arrangement of the color LBP according to the first embodiment.

The control arrangement of the color LBP according to the first embodiment is roughly divided into a printer controller 200 and a printer engine 220. The printer controller 200 and the printer engine 220 are connected by a video interface 201. More specifically, the printer controller 200 sends a command to the printer engine 220 via the video interface 201. The printer engine 220 sends the status to the printer controller 200. Printing image data is also sent from the printer controller 200 to the printer engine 220 via the video interface 201.

In the printer engine 220, a main control CPU 202 is, e.g., a one-chip microcontroller, which controls, in accordance with control programs stored in an internal ROM, a sensor unit 208 connected to the above-described sensor 39 for detecting the waste toner amount, the sensor 40 for detecting the residual toner amount, and the sensor (to be referred to as a "density detecting sensor" hereinafter) 38 for reading the patch density, a fixing unit 207, an image processing unit 210 for performing processing such as pulse width modulation (PWM) for image data received via the video interface 201, an image forming unit 209 for performing control related to image output such as control of laser beam output and control of a scanner motor, and a mechanism control CPU 203 serving as a sub-CPU.

The mechanism control CPU 203 is, e.g., a one-chip microcontroller, which controls a driving unit 204*a* for a motor, a clutch, and the like, a sensor unit 204*b* for them, a paper feed control unit 205, and a high-voltage control unit 206 in accordance with control programs stored in an internal ROM.

[Density Control and Density Measurement]

Density control and density measurement in the first embodiment will be described below. These control operations are performed by the main control CPU 202 and the mechanism control CPU 203.

Density control will be first explained. Under the control of the main control CPU 202, a latent image corresponding to patch data formed by the image processing unit 210 is formed on the photosensitive drum 15 by the image forming unit 209. The latent image is developed and transferred to the intermediate transfer drum 9. A plurality of patches are formed on the intermediate transfer drum 9. The densities of these patches are set stepwise by changing the image forming voltage generated by the high-voltage control unit 206 stepwise.

Upon completion of formation of the patch images, the main control CPU 202 obtains an image forming voltage for forming an image at a proper density on the basis of the density information of each patch image read by the density detecting sensor 38. The main control CPU 202 inputs the obtained voltage value to the mechanism control CPU 203. In subsequent image formation, this voltage is output from the high-voltage control unit 206.

Density measurement is executed as follows. A halftone control parameter, e.g., patch data for determining, e.g., a gamma table is input from the printer controller 200 via the video interface 201. A latent image corresponding to the patch data is formed on the photosensitive drum 15 by the image forming unit 209. The latent image is developed and transferred to the intermediate transfer drum 9. A plurality of patches having different densities are formed on the intermediate transfer drum 9. Note that a voltage output from the high-voltage control unit 206 at this time is the voltage obtained by the density control described above.

After the patch images are formed, the main control CPU 202 reads the density of each patch image with the density detecting sensor 38 and informs the printer controller 200 of the read density via the video interface 201. The printer controller 200 determines the halftone control parameter based on the informed density information.

[Density Control Timing and Density Measurement Timing]

Figure 3:
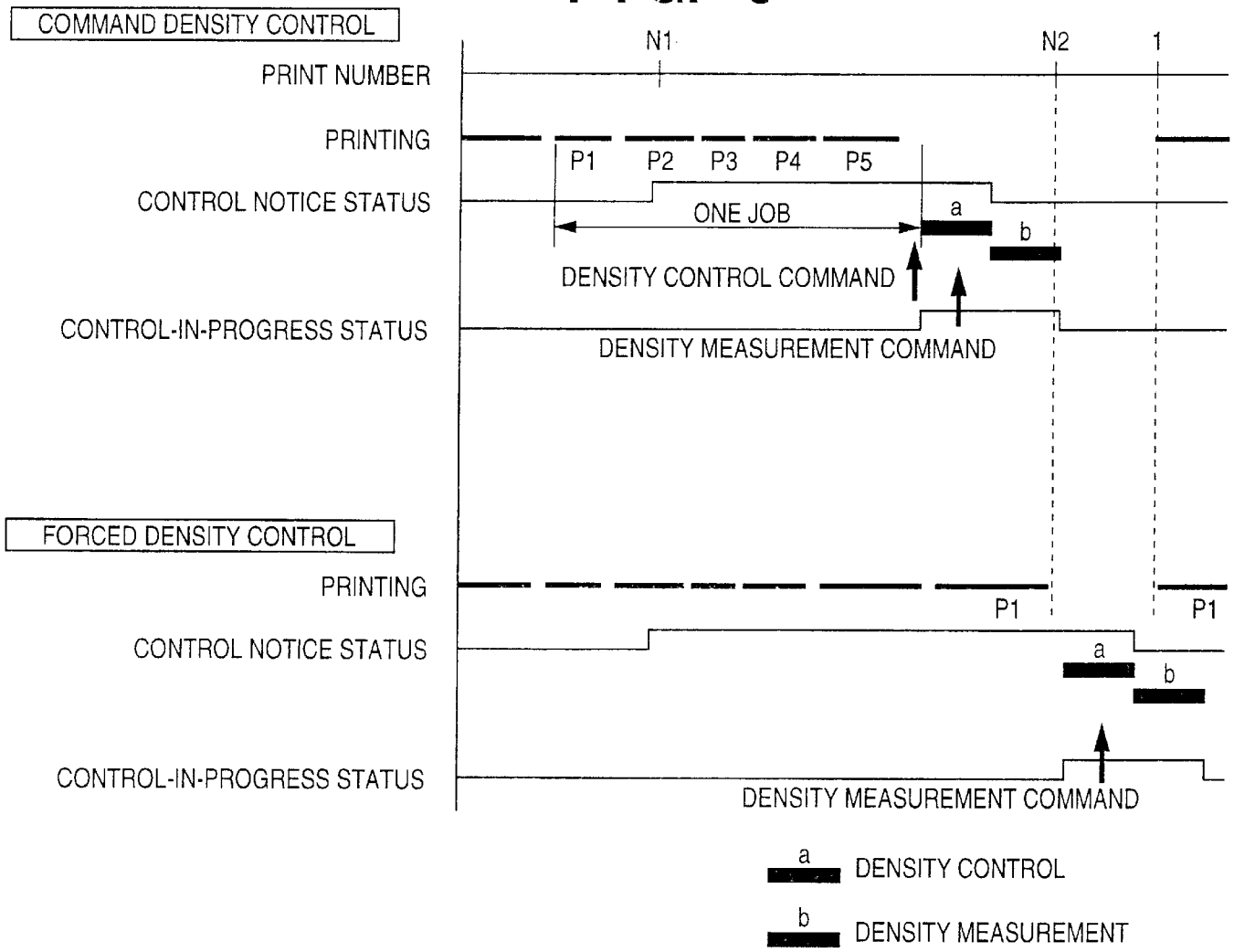
FIG. 3 is a timing chart showing an example of the execution timings of density control and density measurement.

FIG. 3 is a timing chart showing an example of the execution timings of the above-mentioned density control and density measurement in the first embodiment. In FIG. 3, the upper half shows a timing example of "command density control" processing, and the lower half shows a timing example of "forced density control" processing.

"Command density control" shown in FIG. 3 means that a "density control notice status (to be referred to as a "control notice status" hereinafter)" directing the printer controller 200 to execute density control is set after the printer engine 220 is powered on or a predetermined number (N1 in FIG. 3) of paper sheets have been printed upon execution of the latest density control.

In FIG. 3, each thick line on the "print" row represents continuous printing by the printer engine 220 at the highest throughput. Since the "control notice status" is set, the printer controller 200 issues a "density control execution command (to be referred to as a "density control command" hereinafter)" to the printer engine 220 upon completion of one job as a group of continuous printing operations P1 to P5. Upon reception of this, the printer engine 220 executes density control.

During the density control, a "density control executing status (to be referred to as a "control-in-progress status" hereinafter)" is set. If a "density measurement execution command (to be referred to as a "density measurement command" hereinafter)" instructing density measurement is issued from the printer controller 200 while the "control-in-progress status" is set, the printer engine 220 executes density measurement subsequent to density control. Also during the density measurement, the "control-in-progress status" is set. The "control notice status" is reset upon completion of density control, and the "control-in-progress status" is reset upon completion of density control and density measurement.

"Forced density control" will be explained next. Although the printer controller 200 is informed of the "control notice status" instructing density control, it does not issue a "density control command" instructing density control. In this case, the printer engine 220 forcibly interrupts continuous printing P1 and executes density control after the print number reaches a predetermined number (N2 in FIG. 3).

Also in "forced density control", the "control-in-progress status" is set during execution of density control. If a "density measurement command" instructing density measurement is issued from the printer controller 200 while the "control-in-progress status" is set, the printer engine 220 executes density measurement subsequent to density control. Also during execution of density measurement, the "control-in-progress status" is set. The "control notice status" is reset upon completion of density control, and the "control-in-progress status" is reset upon completion of density control and density measurement.

Figure 4:
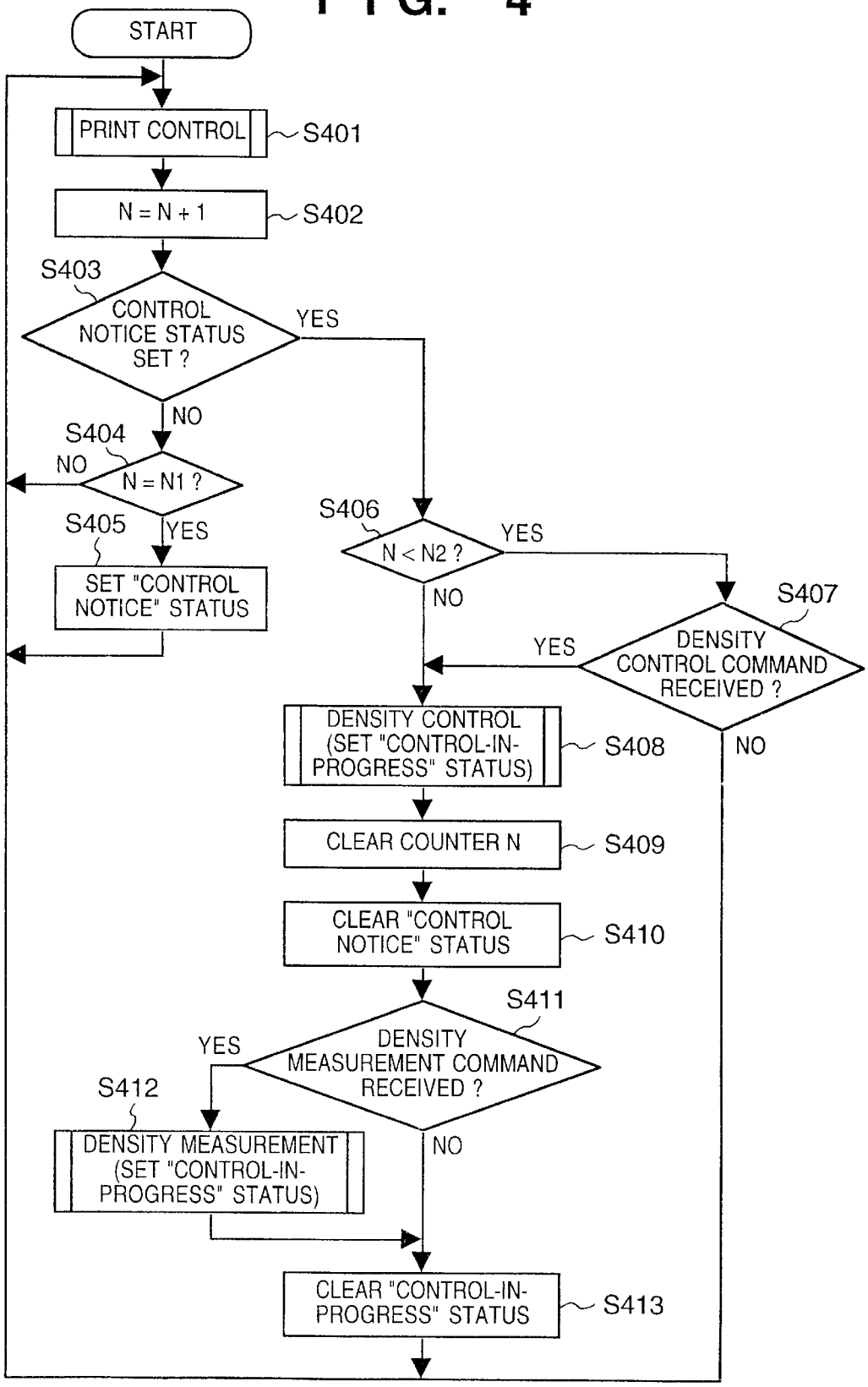
FIG. 4 is a flow chart showing an example of density control and density measurement procedures.

FIG. 4 is a flow chart showing an example of density control and density measurement procedures in the first embodiment. This flow is executed by the main control CPU 202.

In step S401, the main control CPU 202 causes the mechanism control CPU 203 to control printing such as formation of a latent image, developing, paper feeding, and transfer. In step S402, the main control CPU 202 counts up a counter N indicating the print number. In step S403, the main control CPU 202 checks whether the "control notice status" instructing density control is set.

If NO in step S403, the main control CPU 202 checks in step S404 whether the print number N has reached a number N1 for giving a notice of density control. If in step S404 (N=N1), the main control CPU 202 sets the "control notice status" in step S405, and the flow returns to step S401.

If YES in step S403, the main control CPU 202 determines in step S406 whether the print number N has reached a number N2 for forcibly executing density control. If N<N2, the main control CPU 202 checks in step S407 whether the "density control command" instructing density control has been received. If NO in step S407, the flow returns to step S401.

If NO in step S406 (N=N2), or a "density control command" has been received, the main control CPU 202 executes density control in step S408, and sets a "control-in-progress status" representing that density control is in progress at the start of density control.

Upon completion of density control, the main control CPU 202 clears the print number counter N in step S409, and clears the "control notice status" in step S410. The main control CPU 202 determines in step S411 whether a "density measurement command" instructing density measurement has been received during the density control. If YES in step S411, the main control CPU 202 executes density measurement in step S412, and sets the "control-in-progress status" at the start of density measurement.

The main control CPU 202 clears the "control-in-progress status" in step S413, and the flow returns to step S401.

According to the first embodiment, the printer engine 220 can forcibly execute image density control after printing on a predetermined number of sheets.

By informing an external device such as the printer controller 200 of the image density control execution timing by the "control notice status", the printer controller 200 can be caused to issue a "density control command". The printer controller 200 can send the "density control command" to the printer engine 220 at a timing considering the contents of one continuous print job and cause the printer engine 220 to perform image density control.

The printer engine 220 forcibly executes image density control if it does not receive a "density control command" from the printer controller 200 until the print number reaches a predetermined number after the printer controller 200 is informed of the "control notice status".

Both when image density control is executed by the "density control command" and when image density control is forcibly executed, the printer engine 220 sends a "control-in-progress status" representing "during execution of image density control" to the printer controller 200. The printer controller 200 must obtain information for controlling the halftone density upon execution of image density control, and thus makes the printer engine 220 execute image density measurement by the "density measurement command". Even while the "control-in-progress status" is set, the printer engine 220 can receive a "density measurement command".

Modification

Figure 5:
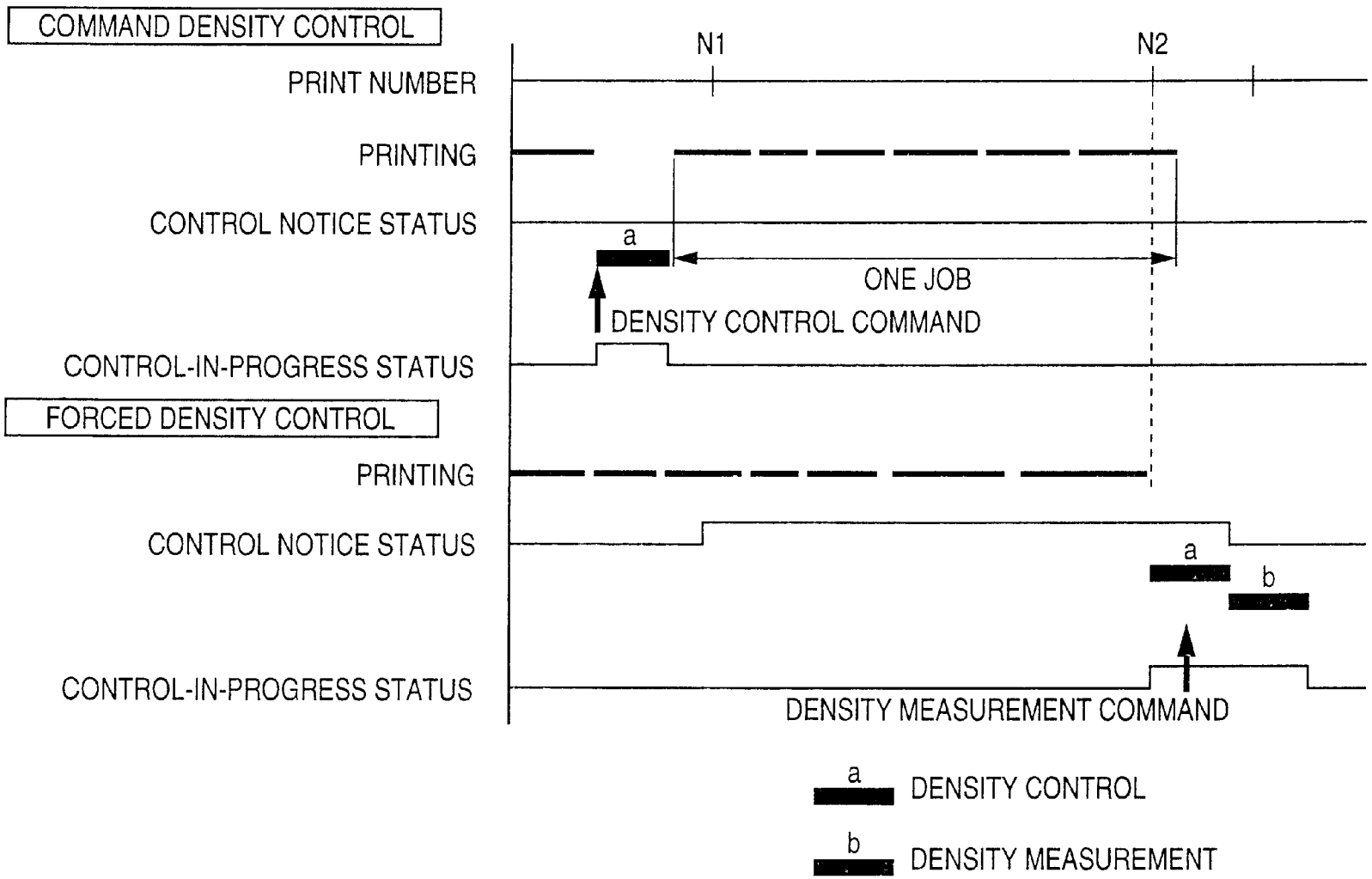
FIG. 5 is a timing chart showing the first modification of the execution timings of density control and density measurement shown in FIG. 3.
Figure 6:
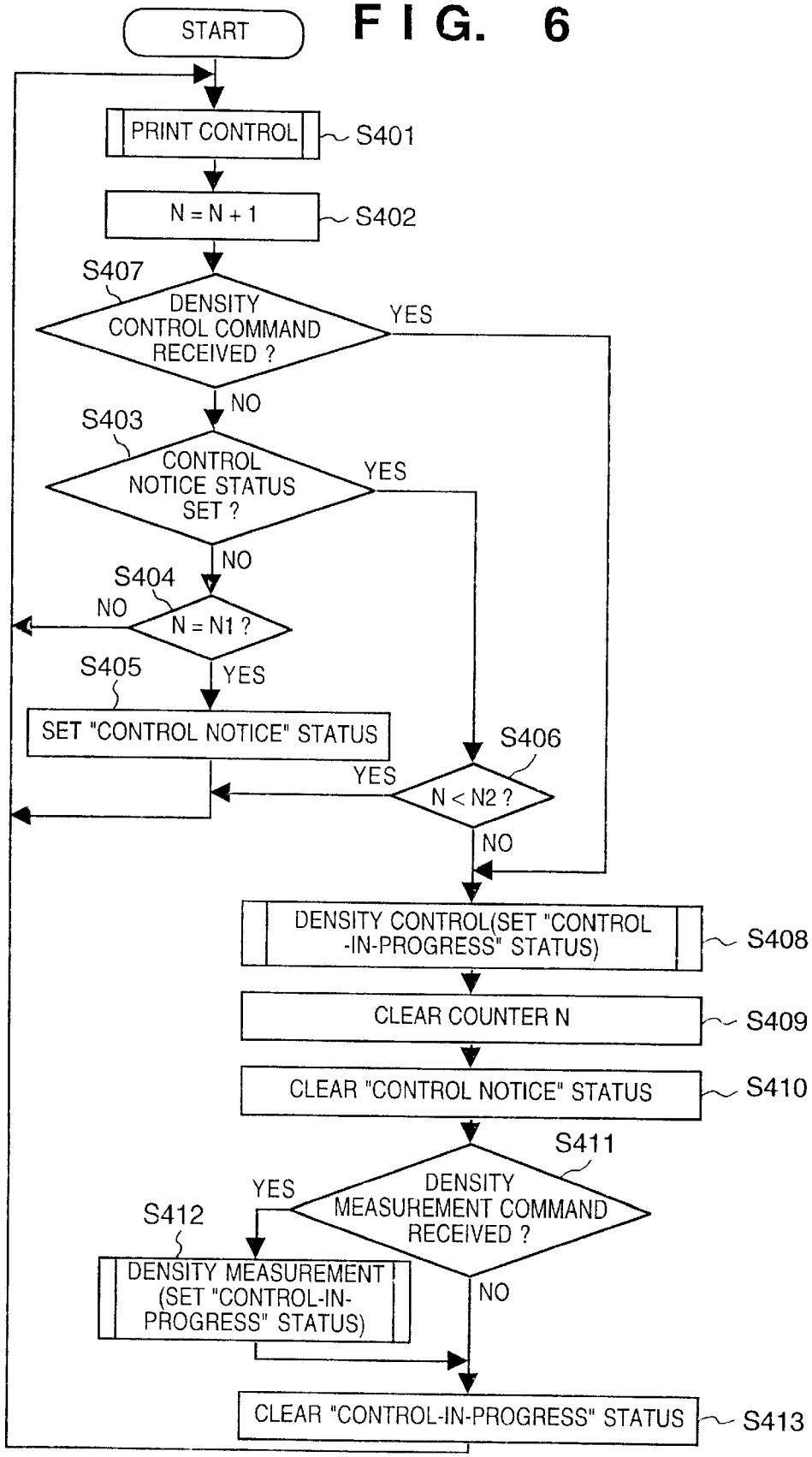
FIG. 6 is a flow chart showing the first modification of the density control and density measurement procedures shown in FIG. 4.

FIG. 5 is a timing chart showing the first modification of the execution timings of density control and density measurement shown in FIG. 3. FIG. 6 is a flow chart showing the first modification of the density control and density measurement procedures shown in FIG. 4. The same reference numerals as in the steps of FIG. 4 denote the steps in which the same processes as in FIG. 4 are performed.

More specifically, in the procedure shown in FIGS. 5 and 6, immediately after the print number N is counted up in step S402, whether a "density control command" has been received is checked in step S407. With this processing, even if the print number N has not reached N1, and no "control notice status" is set, density control in step S408 is executed upon reception of a "density control command".

For example, assume that the print number of the next print job is larger than N2−N1, but no density control is wanted during the print job, i.e., when the print number N reaches N2. In this case, in accordance with the density control and density measurement procedures by the printer engine 220 in FIG. 5, the printer controller 200 can make the printer engine 220 execute density control by issuing a "density control command" before the print number N reaches N1. Therefore, an image density change large enough to be visually noted can be prevented in one job, and the print job currently in progress is not interrupted.

Figure 7:
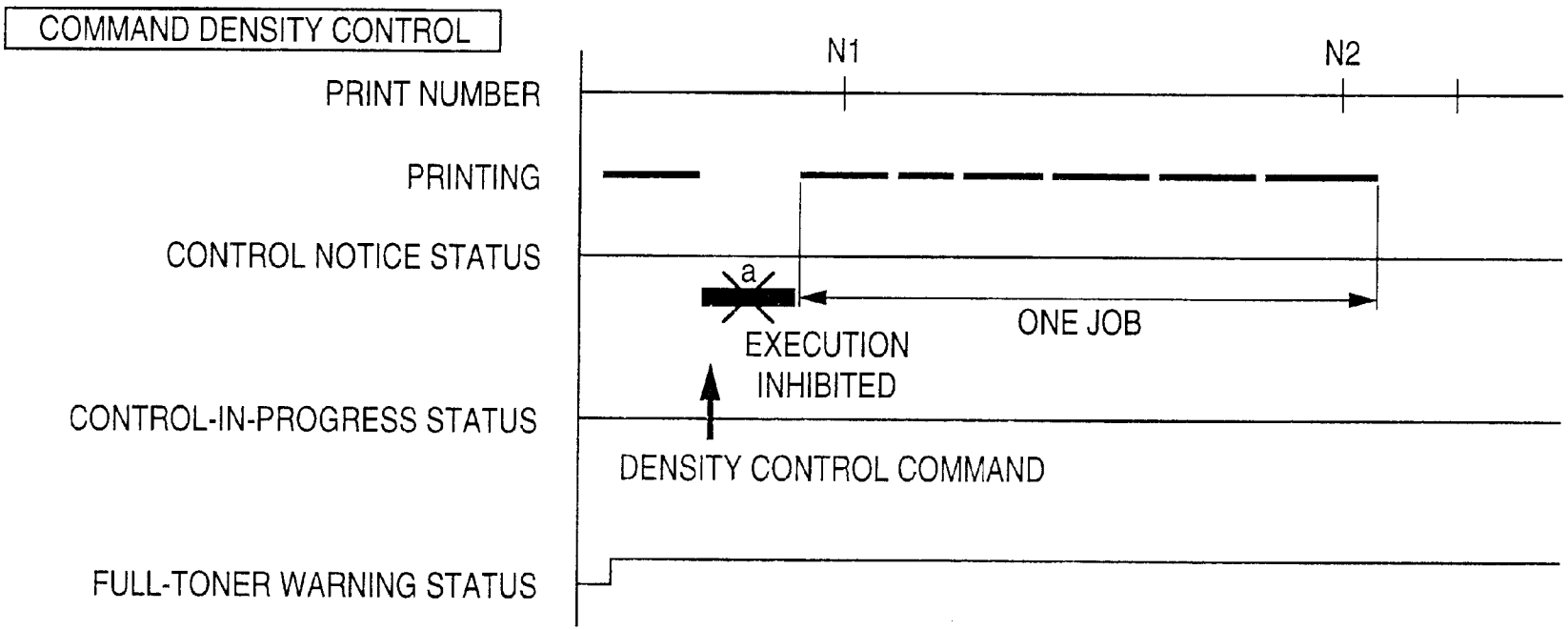
FIG. 7 is a timing chart showing the second modification of the execution timings of density control and density measurement shown in FIG. 5.
Figure 8:
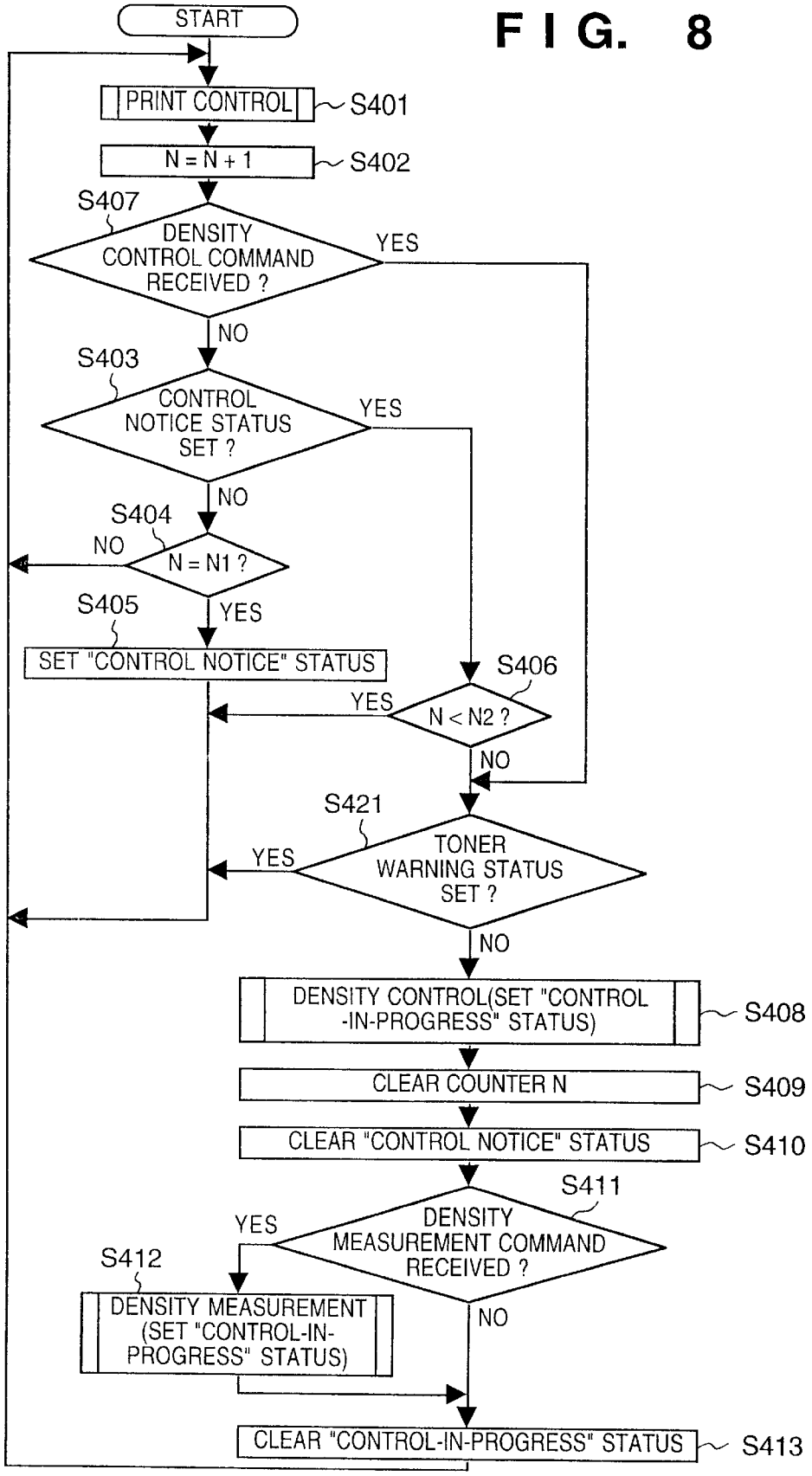
FIG. 8 is a flow chart showing the second modification of the density control and density measurement procedures shown in FIG. 6.

FIG. 7 is a timing chart showing the second modification of the execution timings of density control and density measurement shown in FIG. 5. FIG. 8 is a flow chart showing the second modification of the density control and density measurement procedures shown in FIG. 6. The same reference numerals as in the steps of FIG. 4 denote the steps in which the same processes as in FIG. 4 are performed.

More specifically, in the second modification, if it is determined in step S421 that a full waste toner warning status (to be referred to as a "full-toner warning status" hereinafter) representing that the vessel 14 of the cleaning unit is full of waste toner is set, the flow returns to step S401 without executing density control in step S408.

In the second modification, while a status improper for execution of image density control, i.e., a toner warning status is sent from the printer engine 220 to the printer controller 200, the printer engine 220 does not execute density control even upon reception of, e.g., a "density control command" from the printer controller 200.

Figure 9:
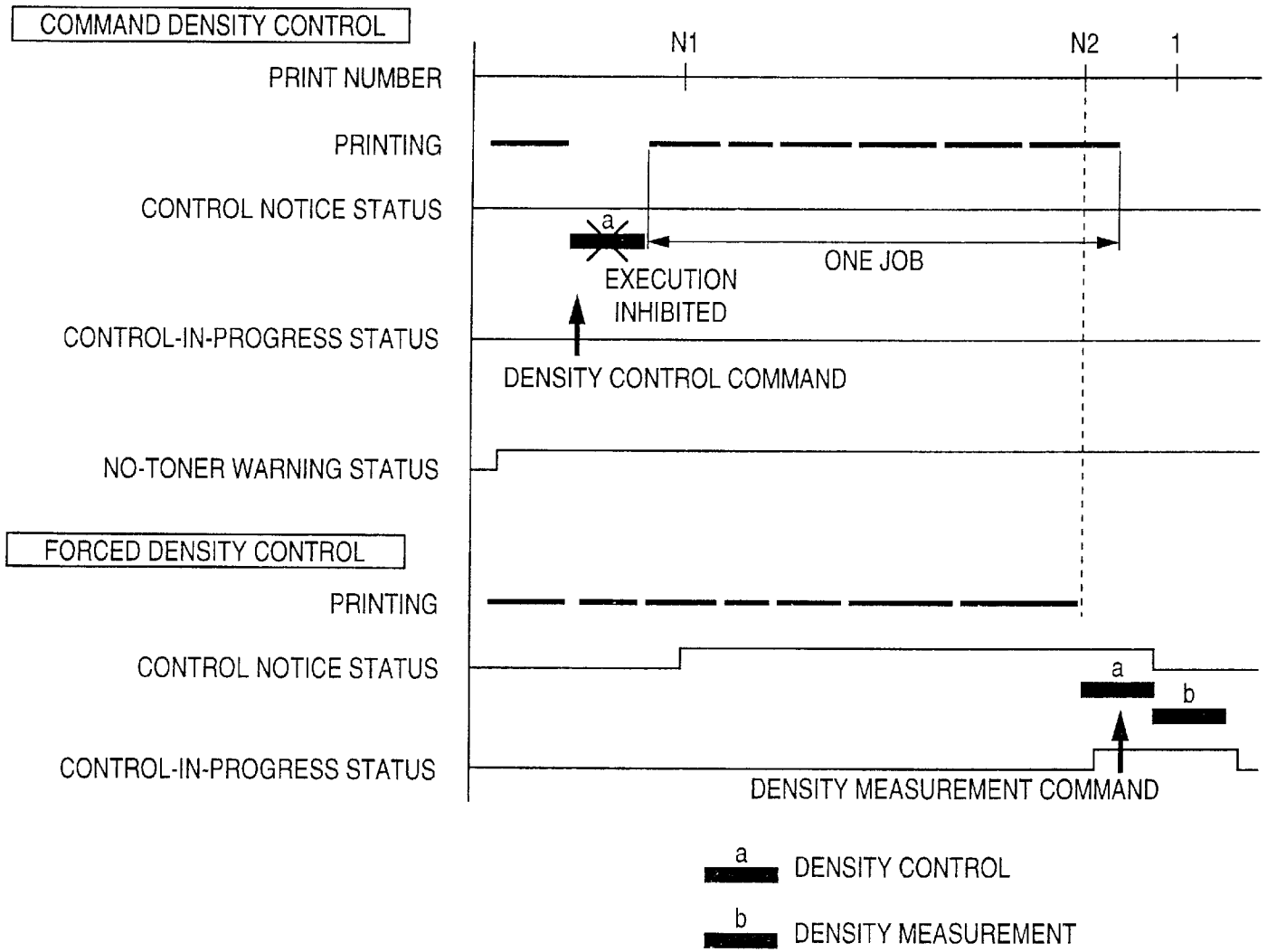
FIG. 9 is a timing chart showing the case where the warning status is different from that in the second modification shown in FIG. 7.

Also when a no-toner warning status representing no developing toner is set, as shown in FIG. 9, the printer engine 220 does not execute density control even upon reception of a "density control command".

In this manner, when the printer engine 220 issues a status representing that no color reproducibility is assured, such as a full-toner warning status or a no-toner warning status, execution of unnecessary density control can be prevented by inhibiting density control.

In summary, according to the first embodiment and the modifications, a decrease in throughput in one continuous print job and an image density change large enough to be visually discernible can be prevented. In addition, the output image density which the color image forming apparatus must assure can be maintained.

Second Embodiment

The second embodiment exemplifies a modification of the density control and density measurement timings in the first embodiment.

In the first embodiment, the timing of command density control and density measurement is set at the time when a predetermined number (N1) of paper sheets have been printed after the latest density control. However, the characteristics, e.g., color reproducibility of an image forming section using electrophotography shown in FIG. 1 requires a long stabilization time. Particularly, the characteristics of the image forming section greatly vary until a predetermined number of images are formed after the power supply is turned on to activate the image forming section.

In the second embodiment, therefore, density control is executed at the following timing in order to execute proper density control in accordance with variations in characteristics of the image forming section.

Figure 10:
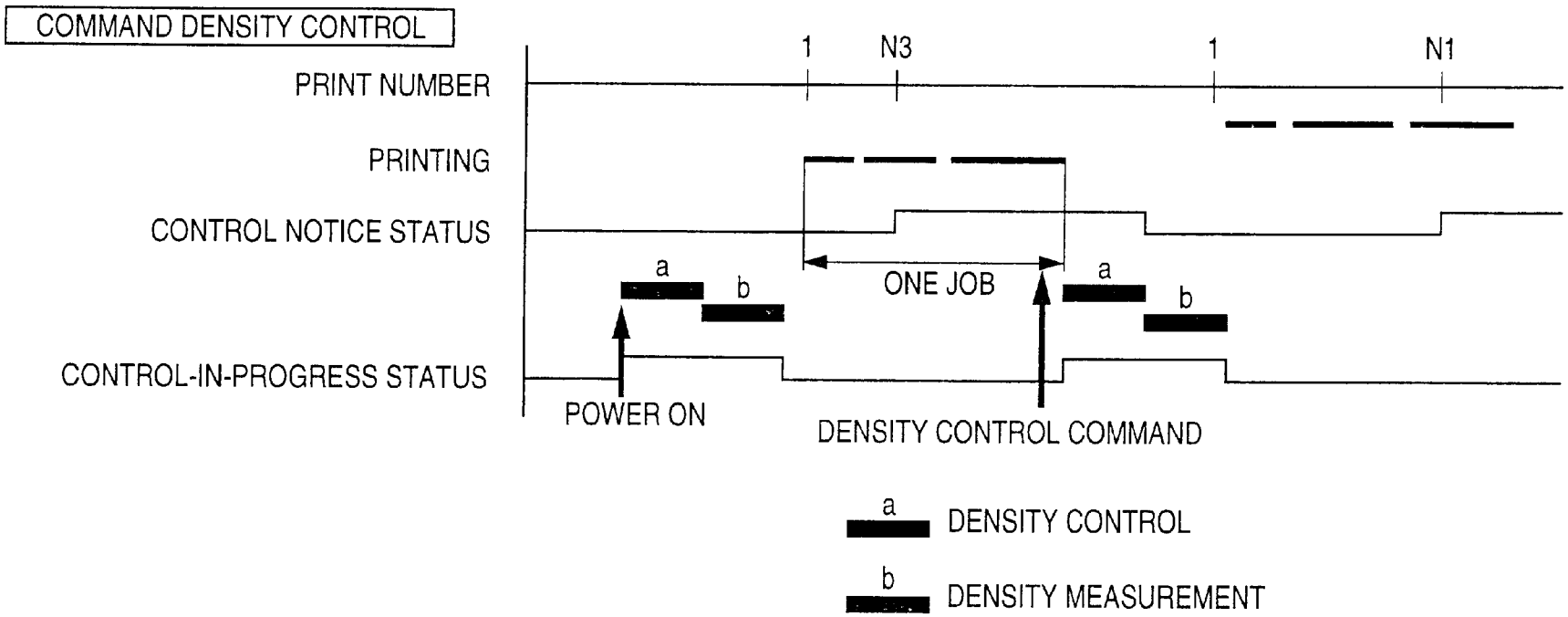
FIG. 10 is a timing chart showing an example of the execution timings of density control and density measurement in the second embodiment.
Figure 11:
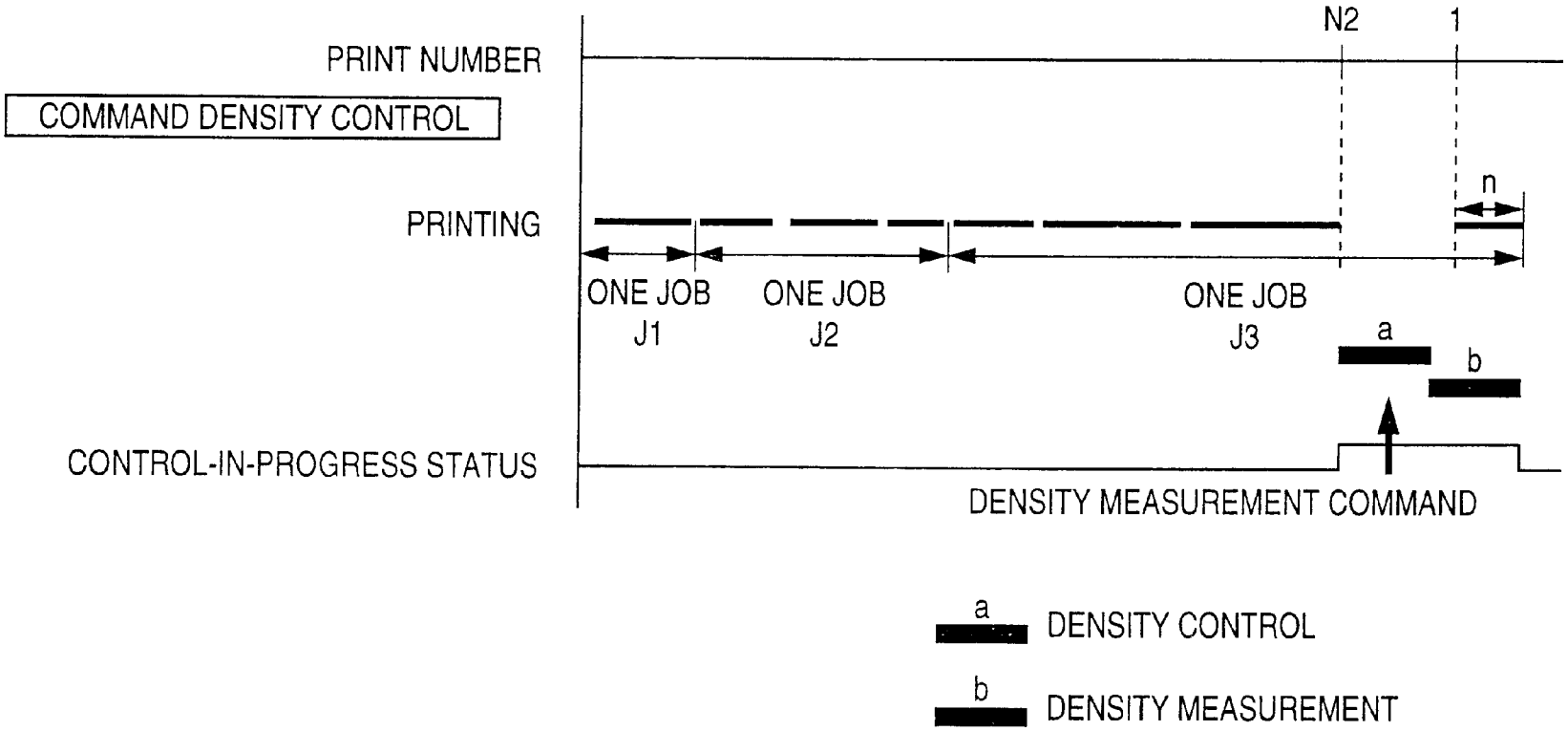
FIG. 11 is a timing chart showing the execution timings of general density control and density measurement.

FIG. 10 is a timing chart showing an example of the execution timings of density control and density measurement in the second embodiment. After the power supply is turned on, a printer engine 220 performs forced density control and density measurement. At the same time, the printer engine 220 informs a printer controller 200 of a notice of density control and directs it to execute density measurement. The printer engine 220 counts the number of images formed upon execution of density control, and when the count value reaches a predetermined number N3, sets the "control notice status" notifying execution of density control. After density control and density measurement at the timing of the predetermined number N3, the printer engine 220 newly counts the number of images formed, and when the count value reaches a predetermined number N1, sets the "control notice status".

The printer engine 220 performs forced density control upon turning on the power supply because the characteristics, e.g., color reproducibility of the image forming section may vary more greatly than those when the count value of the number of images formed reaches N3 or N1. Further, since no job is in progress immediately upon turning on the power supply, no density control timing need be controlled in accordance with the job shown in FIG. 3 or 5. Therefore, the printer engine 220 can perform forced density control without executing any complicated processing considering any job in progress, unlike density control when the count value reaches N3 or N1. As a result, the density control time can be shortened.

The predetermined values N3 and N1 are set in advance in accordance with the variation degree of the characteristics, e.g., color reproducibility of the image forming section. In the second embodiment, the values N3 and N1 are set so N3<N1 holds because the characteristics of the image forming section greatly vary until a predetermined number of images are formed after the power supply is turned on to activate the image forming section.

Note that the same density control and density measurement as in FIG. 5 or 7 in the first embodiment are executed after the "control notice status" is set.

In this fashion, by setting density control execution conditions so as to execute density control in accordance with the variation degree of the characteristics, e.g., color reproducibility of the image forming section, density control can be efficiently, properly performed. That is, unwanted consumption of consumables such as toner owing to frequent density control processes, and a decrease in printing throughput can be prevented. Moreover, high-quality image forming characteristics, e.g., good color reproducibility can be maintained.

Other Embodiments

The present invention may be applied to a system constituted by a plurality of devices (e.g., a host computer, an interface device, a reader, a printer, and the like) or an apparatus comprising a single device (e.g., a copying machine, a facsimile apparatus, or the like)

The object of the present invention is realized even by supplying a storage medium storing software program codes for realizing the functions of the above-described embodiments to a system or an apparatus, and causing the computer (or a CPU or an MPU) of the system or the apparatus to read out and execute the program codes stored in the storage medium. In this case, the program codes read out from the storage medium realize the functions of the above-described embodiments by themselves, and the storage medium storing the program codes constitutes the present invention.

The functions of the above-described embodiments are realized not only when the readout program codes are executed by the computer but also when the OS (Operating System) running on the computer performs part or all of actual processing on the basis of the instructions of the program codes.

The functions of the above-described embodiments are also realized when the program codes read out from the storage medium are written in the memory of a function expansion card inserted into the computer or a function expansion unit connected to the computer, and the CPU of the function expansion card or function expansion unit performs part or all of actual processing on the basis of the instructions of the program codes.

As many apparently widely different embodiments of the present invention can be made without departing from the spirit and scope thereof, it is to be understood that the invention is not limited to the specific embodiments thereof except as defined in the appended claims.

What is claimed is:

1. An image processing apparatus comprising:

communication means for exchanging a command and a status with an external device;

forming means for forming a visible image based on input image data on a recording medium; and density control means for controlling a density of the visible image formed by said forming means in accordance with a predetermined command received by said communication means, said density control means transmits a status instructing execution of the density control to said external device via said communication means when the number of visible images formed by said forming means reaches a first predetermined number, and executes the density control regardless of the predetermined command when no density control is executed upon transmission of the status instructing execution of the density control and when the number of visible images formed by said forming means reaches a second predetermined number.

2. The apparatus according to claim 1, wherein said density control means does not execute the density control even upon reception of the predetermined command when said forming means sets a status improper for execution of the density control.

3. The apparatus according to claim 2, wherein the improper status includes a full waste toner warning status.

4. The apparatus according to claim 2, wherein the improper status includes a residual developing toner amount warning status.

5. The apparatus according to claim 1, further comprising density measurement means for obtaining information for controlling a halftone density of the visible image formed by said forming means, said density measurement means receiving a command instructing acquisition of the information via said communication means even during execution of the density control by said density control means.

6. The apparatus according to claim 5, wherein the information for controlling the halftone density that is obtained by said density measurement means is transmitted to said external device via said communication means.

7. The apparatus according to claim 1, wherein said density control means controls the density of the formed visible image by controlling a process condition in said forming means.

8. The apparatus according to claim 1, wherein said density control means controls the density of the formed visible image by controlling gradation correction processing in said forming means.

9. The apparatus according to claim 1, wherein said forming means forms an image by electrophotography.

10. An image processing apparatus comprising:

density control means for causing an image forming section to form an image, and performing density control processing about image formation on the basis of data obtained by measuring the image at a predetermined timing; and discrimination means for discriminating a status of said image forming section, wherein the density control processing is inhibited in accordance with the discriminated status.

11. The apparatus according to claim 10, wherein the density control processing controls a process condition in said image forming section.

12. The apparatus according to claim 10, wherein the density control processing controls gradation correction processing.

13. The apparatus according to claim 10, wherein the status of said image forming section in which the density control processing is inhibited includes a full waste toner warning status.

14. The apparatus according to claim 10, wherein the status of said image forming section in which the density control processing is inhibited includes a residual developing toner amount warning status.

15. The apparatus according to claim 10, wherein said image forming section forms an image by electrophotography.

16. An image processing apparatus comprising:

control means for causing an image forming section to form an image, and controlling an execution timing of density control processing about image formation on the basis of data obtained by measuring the image, wherein said control means executing the density control processing at an activation timing of said image forming section, a timing when the number of images formed by said image forming section reaches a predetermined number N, and a timing when the number of images formed reaches a predetermined number M (N<M).

17. The apparatus according to claim 16, wherein said control means controls the execution timing of said density control processing in accordance with an executing job and the number of images formed.

18. The apparatus according to claim 16, wherein the activation timing of said image forming section is a timing when a power supply is turned on.

19. The apparatus according to claim 16, wherein the density control processing controls a process condition in said image forming section.

20. The apparatus according to claim 16, wherein the density control processing controls gradation correction processing.

21. The apparatus according to claim 16, wherein said image forming section forms an image by electrophotography.

22. A control method for an image processing apparatus having communication means for exchanging a command and a status with an external device, and forming means for forming a visible image based on input image data on a recording medium, comprising:

the first density control step of controlling a density of the visible image formed by said forming means in accordance with a predetermined command received by said communication means;

the status transmission step of transmitting a status instructing execution of the density control to said external device via said communication means when the number of visible images formed by said forming means reaches a first predetermined number; and the second density control step of executing the density control regardless of the predetermined command when no density control is executed upon transmission of the status instructing execution of the density control and when the number of visible images formed by said forming means reaches a second predetermined number.

23. The method according to claim 22, wherein the first and second density control steps includes the step of not executing the density control even upon reception of the predetermined command when said forming means sets a status improper for execution of the density control.

24. The method according to claim 23, wherein the improper status includes a full waste toner warning status.

25. The method according to claim 23, wherein the improper status includes a residual developing toner amount warning status.

26. The method according to claim 22, further comprising the density measurement step of obtaining information for controlling a halftone density of the visible image formed by said forming means, the density measurement step includes the step of receiving a command instructing acquisition of the information via said communication means even during execution of the density control in the first or second density control step.

27. The method according to claim 26, further comprising the halftone transmission step of transmitting the information for controlling the halftone density that is obtained in the density measurement step to said external device via said communication means.

28. The method according to claim 22, characterized in that the first and second density control steps include the steps of controlling a process condition in said forming means.

29. The method according to claim 22, wherein the first and second density control steps include the steps of controlling gradation correction processing in said forming means.

30. A control method comprising:

the image forming step of causing an image forming section to form an image;

the density control step of performing density control processing about image formation on the basis of data obtained by measuring the image at a predetermined timing;

the discrimination step of discriminating a status of said image forming section; and the inhibition step of inhibiting the density control processing in the density control step in accordance with the discriminated status.

31. The method according to claim 30, wherein the density control step includes the step of controlling a process condition in said image forming section.

32. The method according to claim 30, wherein the density control step includes the step of controlling gradation correction processing.

33. The method according to claim 30, wherein the status of said image forming section in which the density control processing is inhibited includes a full waste toner warning status.

34. The method according to claim 30, wherein the status of said image forming section in which the density control processing is inhibited includes a residual developing toner amount warning status.

35. A control method comprising:

the image forming step of causing an image forming section to form an image;

the density control step of controlling density control processing about image formation on the basis of data obtained by measuring the image; and the timing control step of controlling an execution timing of the density control step, wherein the timing control step includes the step of executing the density control step at an activation timing of said image forming section, a timing when the number of images formed by said image forming section creaches a predetermined number N, and a timing when the number of images formed reaches a predetermined number M (N<M).

36. The method according to claim 35, wherein the timing control step includes the step of controlling the execution timing in the density control step in accordance with a job currently in progress and the number of images formed.

37. The method according to claim 35, wherein the density control step comprises controlling a process condition in said image forming section.

38. The method according to claim 35, wherein the density control step includes the step of controlling gradation correction processing.

39. An image processing apparatus comprising:

density control means for causing an inage forming section to form an image, and controlling density for image formation on the basis of data obtained by measuring the image; and timing control means for controllling an execution timing of the density control processing by said density control means in accordance with stability of color reproducibility of said image forming section.

40. The apparatus according to claim 39, wherein said timing control means times execution of the density control processing at a timing when a power supply for said image forming section is turned on.

41. The apparatus according to claim 39, wherein said timing control means controls the execution timing of the density control processing by said density control means in accordance with the number of images formed by said image forming section.

42. The apparatus according to claim 39, wherein said density control means controls a process condition in said image forming section.

43. The apparatus according to claim 39, wherein said density control means controls gradation correction processing.

44. The apparatus according to claim 39, wherein said image forming section forms an image by electrophotography.

45. A control method for an image processing apparatus comprising:

the image forming step of forming an image using an image forming section;

the desity control step of controlling density control processing of image formation on the basis of data obtained by measuring the image; and the timing control step of controlling an execution timing of said density control step in accordance with stability of color reproducibililty of said image forming section.

* * * * *

UNITED STATES PATENT AND TRADEMARK OFFICE

CERTIFICATE OF CORRECTION

PATENT NO. : 6,122,461
DATED : September 19, 2000
INVENTOR(S) : Hayato Shinohara It is certified that error appears in the above-identified patent and that said Letters Patent is hereby corrected as shown below:

Column 6,
Line 12, "sheet.2" should read -- sheet 2 --.

Column 16,
Line 3, "creaches" should read -- reaches --;
Line 17, "inage" should read -- image --;
Line 21, "controllling" should read -- controlling --; and
Line 48, "desity" should read -- density --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*